US010646084B2

(12) United States Patent
Hinchliffe et al.

(10) Patent No.: US 10,646,084 B2
(45) Date of Patent: May 12, 2020

(54) CYCLONIC VACUUM CLEANER WITH MULTIPLE MODES

(71) Applicant: Dyson Technology Limited, Wiltshire (GB)

(72) Inventors: Robert Hinchliffe, Bristol (GB); Daryl Robert Sage, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 198 days.

(21) Appl. No.: 14/753,740

(22) Filed: Jun. 29, 2015

(65) Prior Publication Data

US 2016/0000283 A1 Jan. 7, 2016

(30) Foreign Application Priority Data

Jul. 2, 2014 (GB) ..... 1411749.3

(51) Int. Cl.
*A47L 9/16* (2006.01)
*A47L 9/00* (2006.01)

(52) U.S. Cl.
CPC ..... *A47L 9/1641* (2013.01); *A47L 9/0072* (2013.01); *A47L 9/1625* (2013.01); *A47L 9/1658* (2013.01); *A47L 9/1683* (2013.01)

(58) Field of Classification Search
CPC .... A47L 9/0072; A47L 9/1625; A47L 9/1641; A47L 9/1658; A47L 9/1683
(Continued)

(56) References Cited

U.S. PATENT DOCUMENTS 1,890,070 A * 12/1932 Whiton, Jr. ..... B04C 5/28 209/711
2,119,478 A 5/1938 Whiton, Jr.
(Continued)

FOREIGN PATENT DOCUMENTS

CN 101108106 1/2008
CN 101474601 7/2009
(Continued)

OTHER PUBLICATIONS

International Search Report and Written Opinion dated Sep. 8, 2015, directed to International Application No. PCT/GB2015/051861; 12 pages.

(Continued)

*Primary Examiner* — Joseph J Hail
*Assistant Examiner* — Arman Milanian
(74) *Attorney, Agent, or Firm* — Morrison & Foerster LLP

(57) ABSTRACT

A vacuum cleaner comprising a separating apparatus comprising a first cyclonic separator and a second cyclonic separator arranged in parallel with the first cyclonic separator, an airflow generator arranged to generate an airflow through the first and second cyclonic separators, and a flow control device for controlling the flow of air through the second cyclonic separator. The vacuum cleaner has a first configuration in which the flow control device is arranged to prevent flow of air through the second cyclonic separator such that, in use, air flows through the first cyclonic separator and bypasses the second cyclonic separator, and a second configuration in which the flow control device is arranged to permit flow of air though the second cyclonic separator such that, in use, air flows through the first and second cyclonic separators.

15 Claims, 3 Drawing Sheets

(58) Field of Classification Search
USPC ..... 55/345, 346, 417, 420; 15/352, 319, 347
See application file for complete search history.

(56) References Cited

U.S. PATENT DOCUMENTS 4,373,228 A * 2/1983 Dyson ..... A47L 5/14 15/346
5,275,634 A * 1/1994 Kramer ..... B04C 5/13 15/316.1
5,558,697 A * 9/1996 Dyson ..... A47L 9/1625 55/310
5,930,994 A * 8/1999 Shimato ..... F01N 3/023 55/302
5,947,300 A * 9/1999 Lange ..... B04C 5/02 209/717
6,344,064 B1 * 2/2002 Conrad ..... B01D 45/12 15/350
6,383,266 B1 * 5/2002 Conrad ..... A47L 9/122 15/352
6,440,197 B1 8/2002 Conrad et al.
6,755,897 B2 * 6/2004 Daly ..... F02M 35/022 55/337
6,942,709 B2 * 9/2005 Trautmann ..... B01D 45/12 209/711
7,449,039 B2 * 11/2008 Hong ..... A47L 5/365 55/343
7,752,708 B2 * 7/2010 Gogel ..... A47L 9/20 15/352
7,785,383 B2 * 8/2010 Oh ..... A47L 9/1616 15/352
7,811,349 B2 10/2010 Nguyen
7,951,218 B2 * 5/2011 Oh ..... A47L 9/1625 15/352
8,726,460 B2 * 5/2014 Jonsson ..... A47L 9/1625 15/352
2002/0178696 A1 12/2002 Korff
2003/0084537 A1 * 5/2003 Conrad ..... A47L 5/30 15/353
2003/0131571 A1 * 7/2003 Demarco ..... B01D 45/16 55/324
2003/0221398 A1 * 12/2003 Trautmann ..... B01D 45/12 55/346
2004/0144698 A1 * 7/2004 Hilpert ..... B01D 45/12 209/725
2004/0181898 A1 9/2004 Kondo
2004/0237484 A1 * 12/2004 Altvater ..... F01M 13/023 55/345
2005/0011036 A1 * 1/2005 McCutchen ..... A47L 9/20 15/319
2006/0048487 A1 3/2006 Song et al.
2006/0112941 A1 6/2006 Hilpert et al.
2006/0137309 A1 * 6/2006 Jeong ..... A47L 5/362 55/337
2006/0230720 A1 10/2006 Han et al.
2007/0017064 A1 * 1/2007 Gogel ..... A47L 9/20 15/352
2007/0056137 A1 3/2007 Miner et al.
2007/0095030 A1 5/2007 Oh
2007/0125049 A1 * 6/2007 Menrik ..... A47L 9/1666 55/337
2008/0028940 A1 * 2/2008 Han ..... B01D 45/16 96/417
2008/0047091 A1 2/2008 Nguyen
2010/0242221 A1 * 9/2010 Horne ..... A47L 9/127 15/347
2010/0325834 A1 * 12/2010 Miefalk ..... A47L 9/165 15/347
2012/0080057 A1 * 4/2012 Jonsson ..... A47L 9/1625 134/21
2012/0284952 A1 * 11/2012 Horne ..... A47L 9/1633 15/347
2013/0008468 A1 * 1/2013 Bertram ..... A47L 9/0072 134/10
2014/0059800 A1 * 3/2014 Bassett ..... A47L 9/0072 15/353

FOREIGN PATENT DOCUMENTS

| | | |
|---|---|---|
| DE | 1183347 | 12/1964 |
| EP | 0710153 | 5/1996 |
| GB | 687097 | 2/1953 |
| GB | 757584 | 9/1956 |
| GB | 2502819 | 12/2013 |
| GB | 2508539 | 6/2014 |
| JP | 2005-87657 | 4/2005 |
| JP | 2011-55924 | 3/2011 |
| KR | 2010-0020637 | 2/2010 |
| WO | WO-2012/100332 | 8/2012 |
| WO | WO-2013/168071 | 11/2013 |

OTHER PUBLICATIONS

Search Report dated Nov. 26, 2014, directed to GB Application No. 1411749.3; 1 page.

* cited by examiner

CYCLONIC VACUUM CLEANER WITH MULTIPLE MODES

REFERENCE TO RELATED APPLICATIONS

This application claims priority to United Kingdom Application No. 1411749.3, filed Jul. 2, 2014, the entire contents of which are incorporated herein by reference.

FIELD OF THE INVENTION

This invention relates to a vacuum cleaner, and particularly relates to a vacuum cleaner comprising a cyclonic separator.

BACKGROUND OF THE INVENTION

GB2502819A shows a battery-powered handheld vacuum cleaner which is similar to the handheld vacuum cleaner DC59 manufactured by Dyson and sold in the United Kingdom.

DC59 is a battery-powered lightweight handheld vacuum that comprises a cyclonic separator.

The vacuum cleaner can be operated in two modes: a low-flow mode in which the vacuum can be used to clean lightly soiled floors, and a high-flow mode in which the vacuum can be used to clean heavily soiled floors. Typically, it is expected that the vacuum cleaner will be used in the low-flow mode most of the time in order to conserve battery power. The vacuum cleaner can be switched to the high-flow mode for short, intensive cleaning tasks.

The cyclonic separator comprises a single primary cyclonic separator and a plurality of secondary cyclonic separators. The cyclonic separators are configured to provide optimum separation efficiency when the vacuum cleaner is operated in the low-flow mode.

When the vacuum cleaner is operated in the high-flow mode, the greater airflow through the vacuum cleaner means that the secondary cyclonic separators become choked, which is detrimental to the performance of the vacuum cleaner.

SUMMARY OF THE INVENTION

According to a first aspect of the invention there is provided a vacuum cleaner comprising a separating apparatus comprising a first cyclonic separator and a second cyclonic separator arranged in parallel with the first cyclonic separator, an airflow generator arranged to generate an airflow through the first and second cyclonic separators, and a flow control device for controlling the flow of air through the second cyclonic separator, wherein the vacuum cleaner has a first configuration in which the flow control device is arranged to prevent flow of air through the second cyclonic separator such that, in use, air flows through the first cyclonic separator and bypasses the second cyclonic separator, and a second configuration in which the flow control device is arranged to permit flow of air though the second cyclonic separator such that, in use, air flows through the first and second cyclonic separators.

The airflow generator may have a low-flow configuration in which the airflow generator generates a flow of air through the separating apparatus at a first flow rate, and a high-flow configuration in which the airflow generator generates a flow of air through the separating apparatus at a second flow rate which is greater than the first flow rate.

The vacuum cleaner may be configured such that, in use, the airflow generator operates in the low-flow configuration when the vacuum cleaner is in the first configuration and the airflow generator operates in the high-flow configuration when the vacuum cleaner is in the second configuration.

The vacuum cleaner may be configured such that, in use, the flow rate through the first cyclonic separator when the vacuum cleaner is in the first configuration is the same as the flow rate through the first cyclonic separator when the vacuum cleaner is in the second configuration.

The first and second cyclonic separators may be configured such that, in use, when the vacuum cleaner is in the second configuration, the flow rate through the first cyclonic separator is the same as the flow rate through the second cyclonic separator.

The first and second cyclonic separators may be identical.

The separating apparatus may comprise a plurality of first cyclonic separators. The first cyclonic separators may be identical.

The separating apparatus may comprise a plurality of second cyclonic separators. The second cyclonic separators may be identical.

The vacuum cleaner may further comprise a first debris collector arranged to collect debris separated from the airflow by the first cyclonic separator, and a second debris collector arranged to collect debris separated from the airflow by the second cyclonic separator. The first and second debris collectors may be fluidly isolated from each other.

The separating apparatus may comprise a primary separator disposed upstream and in series with the first and second cyclonic separators. The primary separator may be a cyclonic separator. Alternatively, the primary separator may be an inertial separator.

The flow control device may comprise a valve. The valve may be disposed downstream of the second cyclonic separator.

The vacuum cleaner may be a battery-powered vacuum cleaner.

The vacuum cleaner may further comprise a user-operable switch which is configured such that a user can switch the vacuum cleaner between the first configuration and the second configuration.

BRIEF DESCRIPTION OF THE DRAWINGS

In order to better understand the present invention, and to show more clearly how the invention may be put into effect, the invention will now be described, by way of example, with reference to the following drawings.

DETAILED DESCRIPTION OF THE INVENTION

Figure 1:
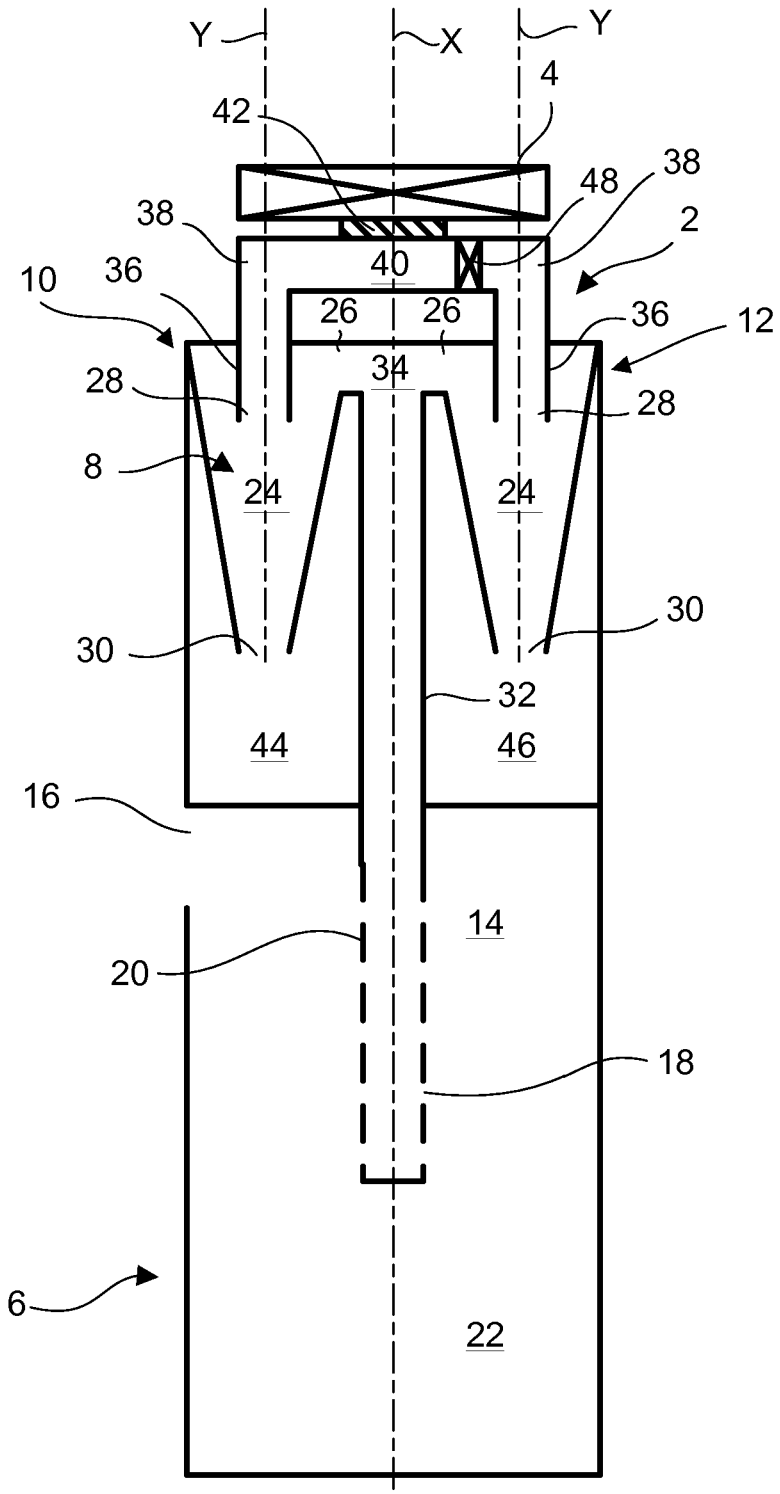
FIG. 1 is a schematic representation of a separating apparatus and an airflow generator of a vacuum cleaner.

FIG. 1 is a schematic representation of a separating apparatus 2 and an airflow generator 4 of a battery-powered vacuum cleaner.

The separating apparatus 2 comprises a primary cyclonic separator 6 and a plurality of secondary cyclonic separators 8 disposed fluidly downstream of the primary cyclonic separator 6 (the secondary cyclonic separators 8 are in series with the primary cyclonic separator 6). The secondary cyclonic separators 8 are arranged so that they are fluidly in parallel with each other.

The secondary cyclonic separators 8 comprise two sets of cyclonic separators: a first set of cyclonic separators 10 and a second set of cyclonic separators 12. In the embodiment shown, the first set of separators 10 comprises ten cyclonic separators 8 and the second set of separators comprises five cyclonic separators. There are fifteen secondary cyclonic separators 8 in total; however, for ease of reference, only one cyclonic separator 8 from each set 10, 12 is shown. The performance characteristics of all of the secondary cyclonic separators 8 are identical.

The airflow generator 4 is disposed downstream of the secondary cyclonic separators 8. The airflow generator 4 is arranged to draw air through the primary cyclonic separator 6 and the secondary cyclonic separators 8. The airflow generator 4 may comprise a motor and an impeller (not shown). The airflow generator 4 has two modes of operation: a low-flow mode and a high-flow mode. In the low-flow mode, the airflow generator 4 generates a low volumetric flow rate of air through the separating apparatus 2. In the high-flow mode, the airflow generator 4 generates a relatively high volumetric flow rate of air through the separating apparatus 2 compared with the low-flow mode.

The primary cyclonic separator 6 comprises a cylindrical separating chamber 14 having an air inlet 16 and an air outlet 18. The air inlet 16 is provided in a side wall of the separating chamber 14. The air inlet 16 is configured to produce a rotational flow within the separating chamber 14 about a central axis X of the separating chamber 14.

A cylindrical screen 20 extends coaxially with the central axis X within the separating chamber 14. The cylindrical screen 20 acts as a vortex finder within the separating chamber 14. Holes in the screen 20 provide the outlet 18 from the separating chamber 14. Such an arrangement is commonly referred to as a shroud.

A dirt collection chamber 22 is provided below the separating chamber 14 and the air outlet 18. The dirt collection chamber 22 may be formed by a bin which is detachable from the remainder of the separating apparatus 2.

The secondary cyclonic separators 8 are disposed above the primary cyclonic separator 6 and are arranged in an array which extends around the central axis X. Each secondary cyclonic separator 8 comprises a separating chamber 24, which in the embodiment shown is conical, having an air inlet 26, an air outlet 28 and a solids outlet 30. The air inlet 26 is arranged to generate a rotational flow within the separating chamber 24.

A primary outlet duct 32 extends upwardly from the cylindrical screen 20 to an inlet manifold 34. The inlet manifold 34 is in fluid communication with each of the respective air inlets 26 of the secondary cyclonic separators 8.

A vortex finder 36 extends from the upper region of the separating chamber 24 of each of the secondary cyclonic separators 8. Each vortex finder 36 comprises an open-ended tube that extends along an axis Y of each secondary cyclonic separator 8. The air outlet 28 of each secondary cyclonic separator 8 is defined by the opening at the lower end of the vortex finder 36. Each air outlet 28 is in fluid communication with the airflow generator 4 via the vortex finder 36, an outlet duct 38 and a common outlet manifold 40 into which each outlet duct 38 opens. An optional filter 42 is disposed between the outlet manifold 40 and the airflow generator 4.

The solids outlet 30 is located at the lower end of the separating chamber 24 of each secondary cyclonic separator 8. A first fine dirt collection chamber 44 is disposed beneath the solids outlets 30 of the first set of cyclonic separators 10. A second fine dirt collection chamber 46 is disposed beneath the solids outlets 30 of the second set of cyclonic separators 12.

The first and second fine dirt collection chambers 44, 46 are separate chambers that are fluidly isolated from each other: that is, air cannot pass directly from one of the chambers 44, 46 to the other.

A flow control device in the form of a valve 48 is disposed at a junction between the outlet ducts 38 for the second set of cyclonic separators 12 and the outlet manifold 40. The valve 48 has a closed state in which air is prevented from being drawn by the airflow generator 4 through the second set 12 of secondary cyclonic separators 8 and an open state in which air can be drawn by the airflow generator 4 through the second set 12 of secondary cyclonic separators 8.

When the valve 48 is closed, air flows through the primary cyclonic separator 6 and the first set 10 of secondary cyclonic separators 8 only. When the valve 48 is open, air flows through the primary cyclonic separator 6 and both the first and second sets 10, 12 of secondary cyclonic separators 8.

The airflow generator 4 and the valve 48 are connected to a controller (not shown), for example a Programmable Logic Controller, which controls operation of the airflow generator 4 and the valve 48.

The controller may be configured to control the airflow generator 4 and the valve 48 automatically, for example in response to a sensed reduction in pressure within a cleaner head attached to the vacuum cleaner, or in response to a command initiated by a user, for example, by actuating a switch provided on the vacuum cleaner. The valve 48 may be controlled via a mechanical, electromagnetic, hydraulic or pneumatic actuator connected to the controller.

Figure 2:
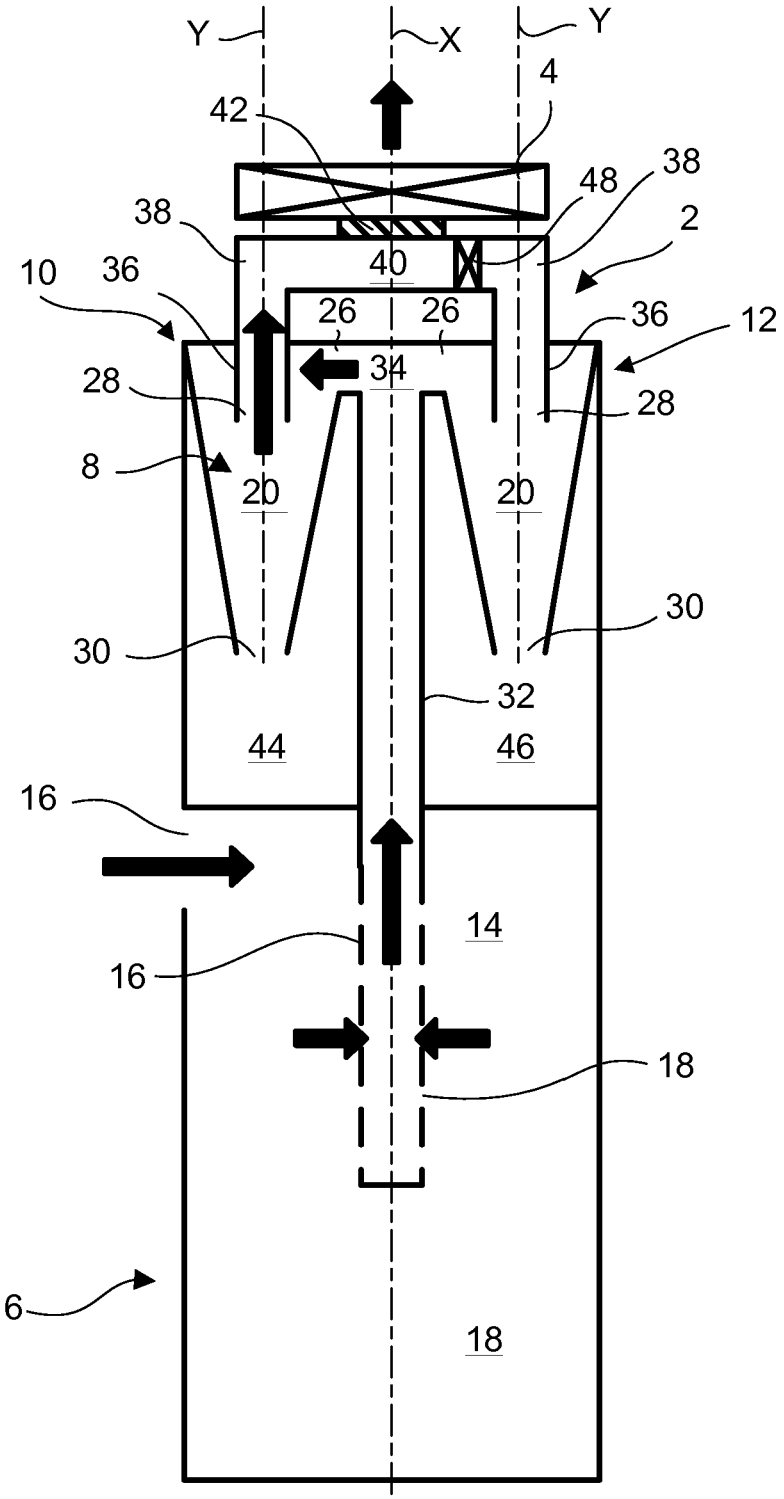
FIG. 2 is a schematic representation of the separating apparatus and airflow generator shown in FIG. 1 showing an airflow through the separating apparatus when the separating apparatus is in a first configuration.
Figure 3:
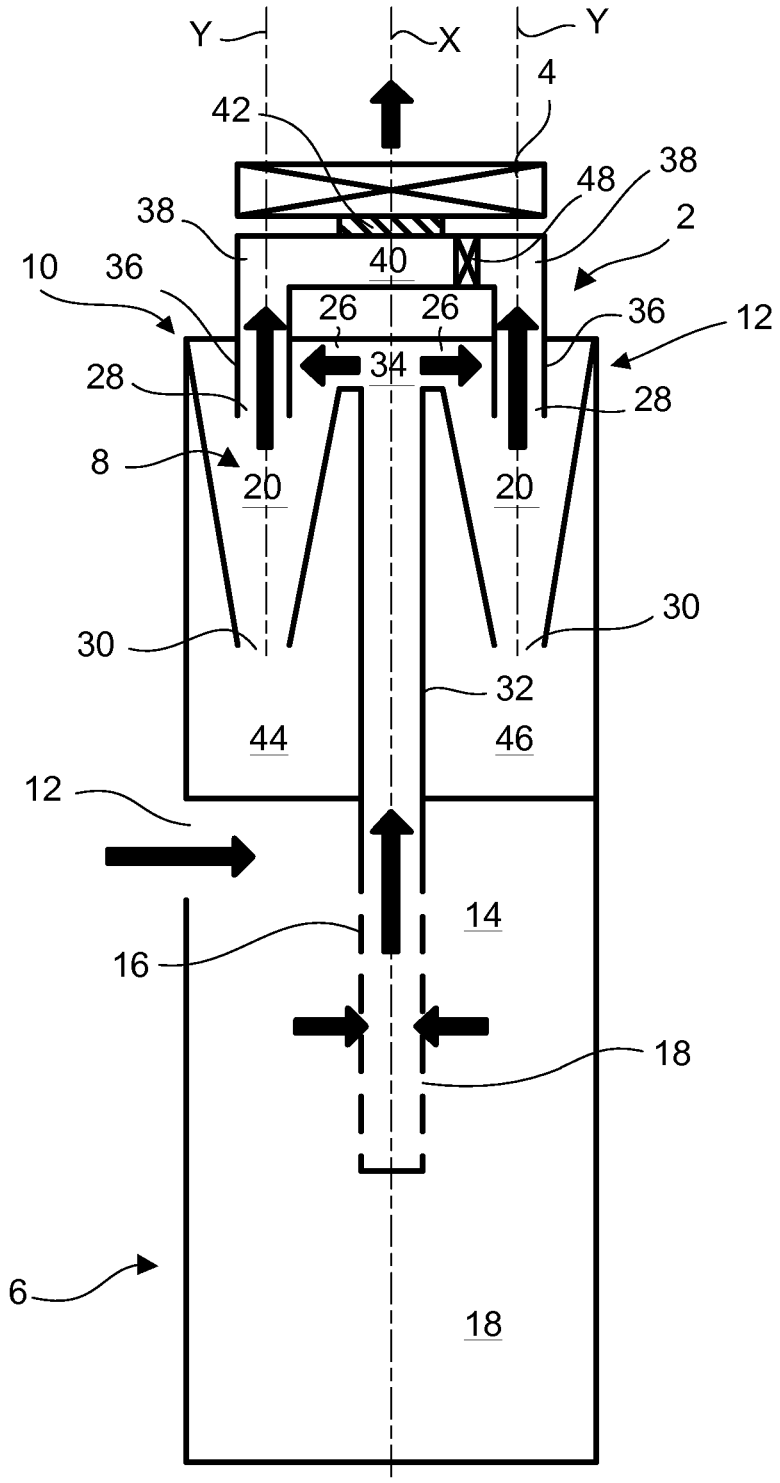
FIG. 3 is a schematic representation of the separating apparatus and airflow generator shown in FIG. 1, showing an airflow through the separating apparatus when the separating apparatus is in a second configuration.

The vacuum cleaner has a first configuration (shown in FIG. 2) in which the airflow generator 4 is in the low-flow mode and the valve 48 is closed, and a second configuration (shown in FIG. 3) in which the airflow generator 4 is in the high-flow mode and the valve 48 is open. The first configuration is suitable for cleaning lightly soiled surfaces without drawing a large amount of power from the battery. The higher flow rate in the second configuration translates into an increase in the pick-up performance of the vacuum cleaner, which is of particular benefit for cleaning heavily soiled surfaces. The controller is configured to control the airflow generator 4 and the valve 48 simultaneously so that the vacuum cleaner can be switched between the first and second configurations simply.

In the first configuration, the airflow generator 4 generates a relatively low flow rate of air through the primary cyclonic separator 6 and the first set of secondary cyclonic separators 10. Flow through each of the cyclonic separators 8 of the first set 10 of cyclonic separators 8 is distributed evenly. For example, if the airflow generator 4 generates a flow rate of 10 litres/second through the separating apparatus 2, the flow rate through each of the cyclonic separators 8 is 1 litre/second. The cyclonic separators 8 of the first set of the secondary cyclonic separators 10 are configured so that their separation efficiency is optimised for a flow rate of 1 litre/second. Consequently, the cyclonic separators 8 of the first set of cyclonic separators 10 operate at their optimum separation efficiency when the vacuum cleaner is in the first configuration. The optimum separation efficiency is dependent on the required performance characteristics of the vacuum cleaner, and may be a target "cut point" at a particular particle size.

When the vacuum cleaner is switched to the second configuration, the airflow generator 4 generates a relatively high volumetric flow rate of air through the primary cyclonic separator 6, and through both the first and second sets 10, 12 of secondary cyclonic separators 8. Flow through each of the cyclonic separators 8 of the first and second set of separators 10, 12 is distributed evenly. For example, if the airflow generator 4 generates a flow rate of 15 litres/second through the separating apparatus 2, the flow rate through each of the cyclonic separators 8 is 1 litre/second. The cyclonic separators 8 of first set of cyclonic separators 10 therefore continue to operate at their optimum separation efficiency. In addition, the second set of cyclonic separators 12, which are also configured so that their separation efficiency is greatest for a flow rate of 1 litre/second, operate at their optimum separation efficiency.

An advantage of the arrangement described above, is that the secondary cyclonic separators 8 of the separating apparatus 2 having two modes of operation can operate at optimal efficiency in both modes. Poor separation efficiency caused by low speeds or choking of the secondary cyclonic separators is therefore avoided.

The above arrangement is described by way of example only. It will be appreciated that there are other configurations of secondary cyclonic separators that could be used. For example, the first set of cyclonic separators may comprise fewer cyclonic separators than the second set of cyclonic separators, or the number of cyclonic separators in each set may be the same. In each case, the performance characteristics of the first and second sets of cyclonic separators would tailored towards the flow rates at each mode of operation of the airflow generator so that the secondary cyclonic separators operate at their optimum efficiencies in each mode.

In an alternative embodiment, the single valve may be replaced with multiple valves arranged to control the flow of air through each secondary cyclonic separator. The valves could be opened and closed in unison to control flow through the secondary set of cyclonic separators.

It will be appreciated that the flow control device and the airflow generator may be controlled in accordance with a sensed parameter, such as the sensed flow rate through the separator. For example, if the flow rate drops below a predetermined threshold, air flow through the second set of cyclonic separators is stopped by the flow control device in order to maintain (or increase) the separating efficiency of the first set of cyclonic separators.

It will be appreciated that either or both of the first and second sets of cyclonic separators could comprise a single cyclonic separator. For example, both sets could comprise a single cyclonic separator, or the first set could comprise a plurality of cyclonic separators and the second set could comprise a single cyclonic separator, and vice versa.

In a further embodiment, the primary cyclonic separator could be replaced by a non-cyclonic separator, such as an inertial separator.

Further sets of secondary cyclonic separators could be provided having respective flow control devices and the airflow generator could be configured to generate respective airflow rates through the secondary cyclonic separators depending on which sets of separators have air passing through them. For example, a third set of secondary cyclonic separators could be provided having a corresponding flow control device. The airflow generator could be configured to produce a flow rate greater than the high-flow rate when air passes through all of the first, second and third sets of secondary cyclonic separators.

The invention claimed is:

1. A vacuum cleaner comprising:

a separating apparatus comprising a first cyclonic separator and a plurality of second cyclonic separators arranged fluidly in parallel with the first cyclonic separator;

a first debris collector arranged to collect debris separated from the airflow by the first cyclonic separator and a second debris collector arranged to collect debris separated from the airflow by the second cyclonic separators;

an airflow generator arranged to generate an airflow through the first cyclonic separator and the second cyclonic separators; and a single valve located in a common airflow path for the plurality of second cyclonic separators, wherein the vacuum cleaner has a first configuration in which the valve is arranged to prevent flow of air through the second cyclonic separators by shutting off flow through the common airflow path such that, in use, air flows through the first cyclonic separator and is prevented from flowing through the second cyclonic separators, and a second configuration in which the valve is arranged to permit flow of air through the second cyclonic separators by permitting flow through the common airflow path such that, in use, air flows through the first cyclonic separator and the second cyclonic separators fluidly in parallel.

2. The vacuum cleaner of claim 1, wherein the airflow generator has a low-flow mode in which the airflow generator generates a flow of air through the separating apparatus at a first flow rate, and a high-flow mode in which the airflow generator generates a flow of air through the separating apparatus at a second flow rate which is greater than the first flow rate.

3. The vacuum cleaner of claim 2, wherein the vacuum cleaner is configured such that, in use, the airflow generator operates in the low-flow mode when the vacuum cleaner is in the first configuration and the airflow generator operates in the high-flow mode when the vacuum cleaner is in the second configuration.

4. The vacuum cleaner of claim 1, wherein the vacuum cleaner is configured such that, in use, a flow rate through the first cyclonic separator when the vacuum cleaner is in the first configuration is the same as a flow rate through the first cyclonic separator when the vacuum cleaner is in the second configuration.

5. The vacuum cleaner of claim 1, wherein the first cyclonic separator and the second cyclonic separators are configured such that, in use, when the vacuum cleaner is in the second configuration, a flow rate through the first cyclonic separator is the same as a flow rate through at least one of the second cyclonic separators.

6. The vacuum cleaner of claim 1, wherein the first cyclonic separator and the second cyclonic separators are identical.

7. The vacuum cleaner of claim 1, wherein the separating apparatus comprises a plurality of first cyclonic separators.

8. The vacuum cleaner of claim 7, wherein the first cyclonic separators are identical.

9. The vacuum cleaner of claim 1, wherein the second cyclonic separators are identical.

10. The vacuum cleaner of claim 1, wherein the separating apparatus comprises a primary separator disposed upstream and in series with the first cyclonic separator and the second cyclonic separators.

11. The vacuum cleaner of claim 10, wherein the primary separator is a cyclonic separator.

12. The vacuum cleaner of claim 1, wherein the valve is disposed downstream of the second cyclonic separators.

13. The vacuum cleaner claim 1, wherein the vacuum cleaner is a battery-powered vacuum cleaner.

14. The vacuum cleaner of claim 1, further comprising a user-operable switch which is configured such that a user can switch the vacuum cleaner between the first configuration and the second configuration.

15. The vacuum cleaner of claim 1, wherein the first debris collector is fluidly isolated from the second debris collector.

* * * * *